US011826892B2

(12) United States Patent
Elger

(10) Patent No.: US 11,826,892 B2
(45) **Date of Patent: *Nov. 28, 2023**

(54) HAMMER DRILL

(71) Applicant: MILWAUKEE ELECTRIC TOOL CORPORATION, Brookfield, WI (US)

(72) Inventor: William A. Elger, West Bend, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/730,266

(22) Filed: Apr. 27, 2022

(65) Prior Publication Data

US 2022/0250224 A1 Aug. 11, 2022

Related U.S. Application Data

(63) Continuation of application No. 17/032,548, filed on Sep. 25, 2020, now Pat. No. 11,345,009, which is a (Continued)

(51) Int. Cl.
*B25D 16/00* (2006.01)
*B25D 11/10* (2006.01)

(52) U.S. Cl.
CPC ..... *B25D 16/006* (2013.01); *B25D 11/106* (2013.01); *B25D 16/003* (2013.01); (Continued)

(58) Field of Classification Search
CPC .. B25D 16/003; B25D 16/006; B25D 11/106; B25D 2216/0023; B25D 2216/0038
See application file for complete search history.

(56) References Cited

U.S. PATENT DOCUMENTS 3,119,274 A 1/1964 Short
4,229,981 A 10/1980 Macky
(Continued)

FOREIGN PATENT DOCUMENTS

EP 1714745 A1 10/2006

OTHER PUBLICATIONS

International Search Report and Written Opinion for Application No. PCT/US2013/065347 dated Jan. 27, 2014 (13 pages).

*Primary Examiner* — Thomas M Wittenschlaeger
(74) *Attorney, Agent, or Firm* — Michael Best & Friedrich LLP

(57) ABSTRACT

A hammer drill includes a housing, a first ratchet fixed to the housing, a spindle rotatably supported by the housing about an axis, and a second ratchet coupled for co-rotation with the spindle. The second ratchet is engageable with the first ratchet in response to rearward displacement of the spindle to impart a hammering action on the spindle. The hammer drill further includes a thrust bearing having an arm extending away from the axis, and a selector ring having a post extending toward the arm. The selector ring is rotatable between a first position in which the post is engageable with the arm to limit the rearward displacement of the spindle and prevent engagement of the first and second ratchets, and a second position in which the post is misaligned with the arm to permit the rearward displacement of the spindle and engagement of the first and second ratchets.

19 Claims, 4 Drawing Sheets

Related U.S. Application Data continuation of application No. 15/876,303, filed on Jan. 22, 2018, now Pat. No. 10,888,986, which is a continuation of application No. 14/055,954, filed on Oct. 17, 2013, now Pat. No. 9,908,228.

(60) Provisional application No. 61/715,888, filed on Oct. 19, 2012.

(52) U.S. Cl.
CPC ..... *B25D 2216/0023* (2013.01); *B25D 2216/0038* (2013.01)

(56) References Cited

U.S. PATENT DOCUMENTS 4,232,749 A 11/1980 Rohrbach
4,763,733 A 8/1988 Neumaier
4,779,555 A 10/1988 Hong
5,339,908 A 8/1994 Yokota et al.
5,458,206 A 10/1995 Bourner et al.
5,505,271 A * 4/1996 Bourner ..... B25D 16/006 173/205
5,616,096 A 4/1997 Hagiwara
5,628,374 A 5/1997 Dibbern, Jr.
5,711,379 A 1/1998 Amano et al.
6,070,675 A 6/2000 Mayer et al.
6,142,242 A * 11/2000 Okumura ..... B25D 16/00 173/48
6,415,487 B1 7/2002 Leimer
RE37,905 E 11/2002 Bourner et al.
6,520,267 B2 2/2003 Fünfer
6,550,546 B2 4/2003 Thurler et al.
6,656,076 B2 12/2003 Strowik et al.
6,688,406 B1 * 2/2004 Wu ..... B25D 16/00 173/48
6,691,796 B1 * 2/2004 Wu ..... B25D 16/006 173/48
6,719,670 B1 4/2004 Wu et al.
6,843,141 B2 * 1/2005 Spielmann ..... B25B 23/141 173/176
6,860,341 B2 3/2005 Spielmann et al.
6,892,827 B2 * 5/2005 Toyama ..... B25D 16/006 173/48
6,983,810 B2 1/2006 Hara et al.
6,984,188 B2 * 1/2006 Potter ..... B25B 23/141 475/263
7,073,605 B2 7/2006 Saito et al.
7,093,670 B2 8/2006 Saito et al.
7,174,969 B2 2/2007 Droste
7,201,235 B2 * 4/2007 Umemura ..... B23B 45/008 173/217
7,213,659 B2 5/2007 Saito et al.
7,225,884 B2 * 6/2007 Aeberhard ..... B25B 21/00 173/205
7,308,948 B2 12/2007 Furuta
7,314,097 B2 * 1/2008 Jenner ..... B25D 16/006 475/265
7,334,646 B2 2/2008 Hara et al.
7,407,460 B2 8/2008 Eisenhardt
7,607,493 B2 10/2009 Erhardt
7,658,238 B2 2/2010 Toukairin et al.
7,694,750 B2 * 4/2010 Tsubakimoto ..... B25D 17/06 173/13
7,717,192 B2 5/2010 Schroeder et al.
7,735,575 B2 * 6/2010 Trautner ..... B25D 16/006 173/205
7,806,199 B2 10/2010 Pohl et al.
7,896,097 B2 3/2011 Teng
7,900,715 B2 3/2011 Chen
7,987,920 B2 8/2011 Schroeder et al.
8,074,735 B2 12/2011 Aaberhard et al.
8,083,007 B2 12/2011 Inagaki et al.
8,104,544 B2 1/2012 Ullrich et al.
8,109,343 B2 2/2012 Schroeder et al.
8,235,137 B2 8/2012 Walker et al.
8,251,156 B2 8/2012 Norona et al.
8,251,158 B2 * 8/2012 Tomayko ..... B25F 5/001 475/329
8,322,457 B2 12/2012 Mok et al.
9,908,228 B2 * 3/2018 Elger ..... B25D 11/106
10,888,986 B2 * 1/2021 Elger ..... B25D 16/006
11,345,009 B2 * 5/2022 Elger ..... B25D 16/006
2005/0150669 A1 * 7/2005 Umemura ..... B25B 21/00 173/48
2006/0086514 A1 * 4/2006 Aeberhard ..... B25B 21/023 173/48
2006/0213675 A1 * 9/2006 Whitmire ..... B25F 5/001 173/48
2006/0232021 A1 * 10/2006 Schell ..... B23B 31/1253 279/60
2006/0237205 A1 * 10/2006 Sia ..... B25B 23/1405 173/128
2006/0244224 A1 * 11/2006 Zhou ..... B23B 31/001 279/62
2007/0084614 A1 4/2007 Whitmire et al.
2007/0181319 A1 * 8/2007 Whitmine ..... B25B 21/02 173/48
2008/0223592 A1 9/2008 Ehrhardt
2009/0101376 A1 * 4/2009 Walker ..... B25B 21/00 173/47
2010/0071923 A1 * 3/2010 Rudolph ..... B25B 21/02 173/48
2010/0193207 A1 * 8/2010 Mok ..... B25D 11/106 173/48
2011/0048750 A1 3/2011 Leong et al.
2011/0147021 A1 6/2011 Schaal et al.
2011/0220377 A1 9/2011 Roehm
2011/0247848 A1 10/2011 Sieber et al.
2011/0259620 A1 10/2011 Roehm
2012/0175142 A1 7/2012 Van Der Linde et al.
2012/0205131 A1 8/2012 Furusawa et al.
2012/0214640 A1 8/2012 Saur
2021/0008704 A1 1/2021 Elger

* cited by examiner

HAMMER DRILL

CROSS-REFERENCE TO RELATED APPLICATIONS

This application is a continuation of U.S. patent application Ser. No. 17/032,548 filed Sep. 25, 2020, now U.S. Pat. No. 11,345,009, which is a continuation of U.S. patent application Ser. No. 15/876,303 filed Jan. 22, 2018, now U.S. Pat. No. 10,888,986, which is a continuation of U.S. patent application Ser. No. 14/055,954 filed on Oct. 17, 2013, now U.S. Pat. No. 9,908,228, which claims priority to U.S. Provisional Patent Application No. 61/715,888 filed on Oct. 19, 2012, the entire contents of all of which are incorporated herein by reference.

FIELD OF THE INVENTION

The present invention relates to power tools, and more particularly to rotary power tools with hammer mechanisms.

BACKGROUND OF THE INVENTION

Power tools, particularly rotary power tools, are often user-configurable to provide multiple operation modes. For example, an operator of a hammer drill may configure the drill for combined hammering and rotary operation or rotary-only operation by actuating a mode selection mechanism on the device.

SUMMARY OF THE INVENTION

In one aspect, a hammer drill comprises a housing, a first ratchet fixed to the housing, a spindle rotatably supported by the housing about an axis, and a second ratchet coupled for co-rotation with the spindle. The second ratchet is engageable with the first ratchet in response to rearward displacement of the spindle to impart a hammering action on the spindle while the spindle rotates. The hammer drill also comprises a thrust bearing for absorbing an axial load on the spindle in response to the rearward displacement of the spindle. The thrust bearing includes an arm extending away from the axis. The hammer drill further comprises a selector ring including a post extending toward the arm. The selector ring is rotatable between a first position in which the post is engageable with the arm of the thrust bearing to thereby limit the rearward displacement of the spindle and prevent engagement of the first and second ratchets, and a second position in which the post is misaligned with the arm of the thrust bearing to permit the rearward displacement of the spindle and engagement of the first and second ratchets. The selector ring is also rotatable to a third position, wherein the first position corresponds to a first operational mode of the hammer drill, the second position corresponds to a second operational mode of the hammer drill, and the third position corresponds to a third operational mode of the hammer drill.

In another aspect, a hammer drill comprises a housing, a first ratchet fixed to the housing, a spindle rotatably supported by the housing about an axis, and a second ratchet coupled for co-rotation with the spindle. The second ratchet is engageable with the first ratchet in response to rearward displacement of the spindle to impart a hammering action on the spindle while the spindle rotates. The hammer drill also comprises a thrust bearing for absorbing an axial load on the spindle in response to the rearward displacement of the spindle. The thrust bearing includes an arm extending away from the axis. The hammer drill further comprises a selector ring including a post extending toward the arm. The selector ring is rotatable between a first position in which the post is engageable with the arm of the thrust bearing to thereby limit the rearward displacement of the spindle and prevent engagement of the first and second ratchets, and a second position in which the post is misaligned with the arm of the thrust bearing to permit the rearward displacement of the spindle and engagement of the first and second ratchets. The hammer drill also comprises a clutch mechanism operable to limit torque output to the spindle.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
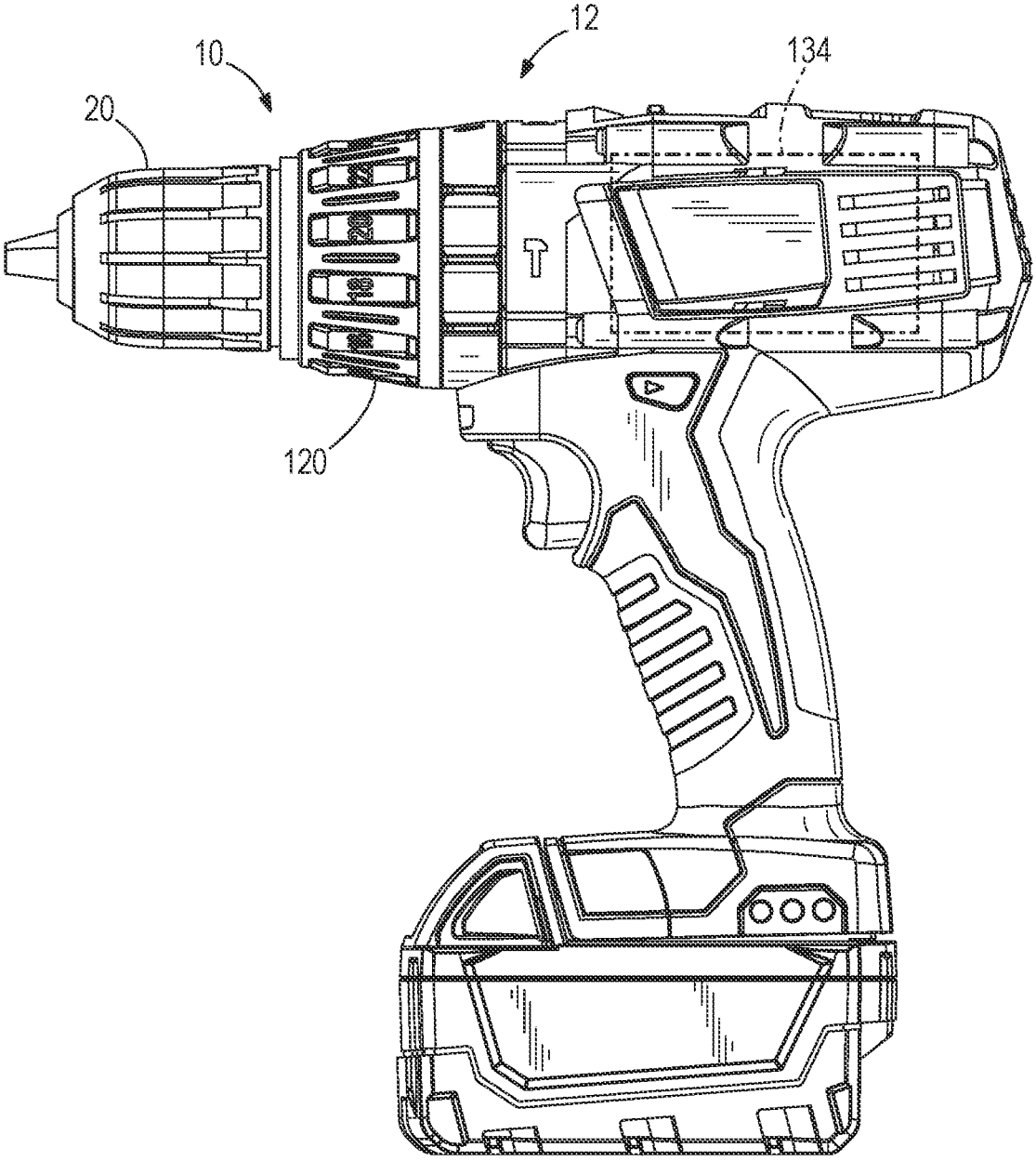
FIG. 1 is a side view of a rotary power tool.
Figure 2:
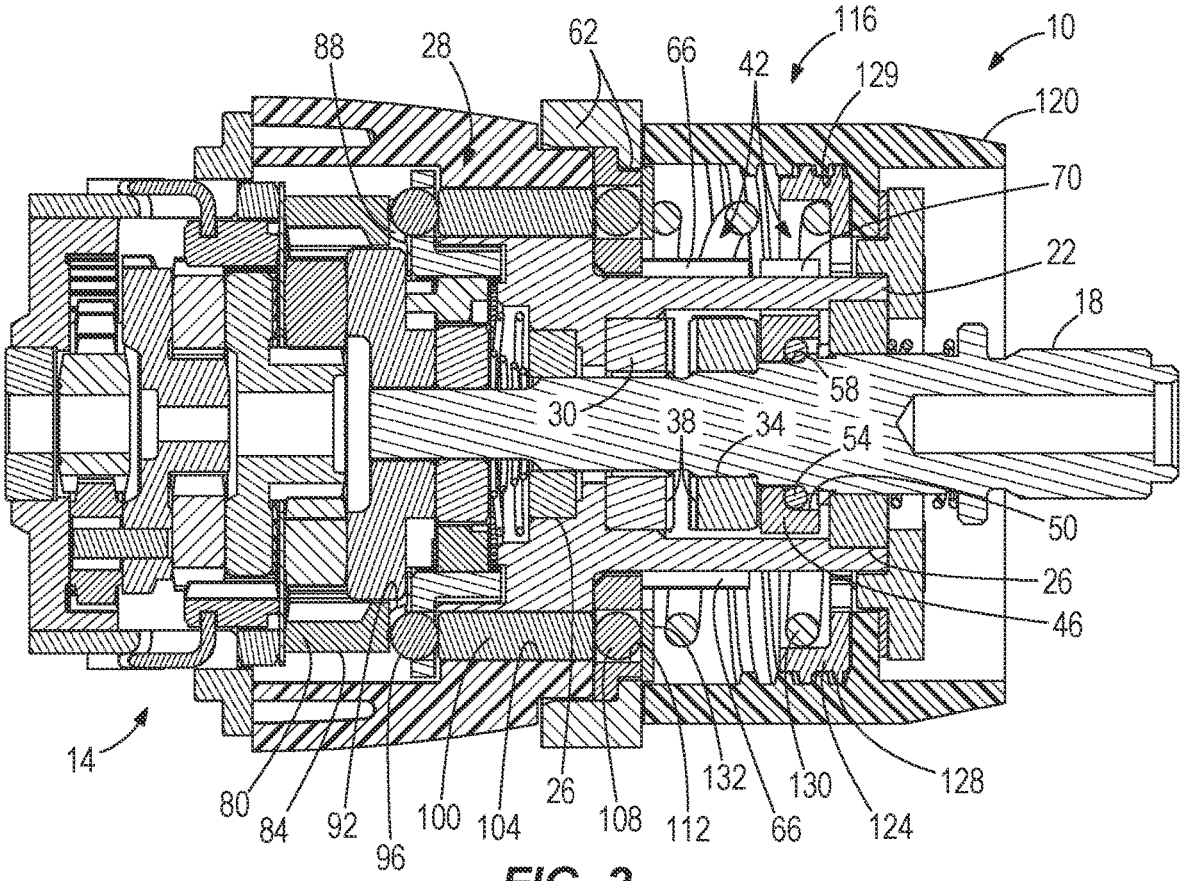
FIG. 2 is a cross-sectional view of a front end assembly of the power tool of FIG. 1.

FIG. 2 illustrates a front end assembly 10 for use with a rotary power tool 12 (e.g., a hammer drill, etc.; FIG. 1). The front end assembly 10 includes a multi-stage planetary transmission 14 (FIG. 2) and a spindle 18 coupled to the output of the transmission 14. The spindle 18 may be coupled to a conventional tool chuck or bit retainer 20 (FIG. 1) in a conventional manner. The transmission 14 includes a front housing portion 22 in which the spindle 18 is rotatably supported by spaced radial bearings 26. An adjustable clutch mechanism 28 may also be used in conjunction with the transmission 14 to selectively limit the amount of torque that may be transferred from the transmission 14 to the spindle 18. However, the transmission 14 need not be used in conjunction with the adjustable clutch mechanism 28.

With continued reference to FIG. 2, the front end assembly 10 includes a fixed ratchet 30 secured within the front housing portion 22 and a rotatable ratchet 34 fixed for co-rotation with the spindle 18 in any of a number of different ways (e.g., by using an interference fit, welding, etc.). The ratchets 30, 34 are engageable in response to the spindle 18 being axially displaced rearward when used, for example, in a hammer-drilling operation. Each of the ratchets 30, 34 includes teeth 38 that are engageable and slidable relative to each other in response to relative rotation between the ratchets 30, 34. As the teeth 38 on the rotatable ratchet 34 slide over the teeth 38 of the fixed ratchet 30, the contour of the teeth 38 impart reciprocation (i.e., "hammering") to the spindle 18 to thereby assist the drilling operation.

The front end assembly 10 further includes a hammer lockout mechanism 42 for selectively inhibiting the ratchets 30, 34 from engaging each other, and therefore inhibiting the hammering action on the spindle 18. The hammer lockout mechanism 42 includes a thrust bearing 46 having an interior raceway 50 and ball bearings 54 positioned between the raceway 50 and a shoulder 58 on the spindle 18. The thrust bearing 46 is generally axially constrained on the spindle 18 by the shoulder 58 and by the rotatable ratchet 34. As such, the thrust bearing 46 absorbs rearward axial loads applied to the spindle 18 during a drilling operation or a fastener-driving operation.

Figure 3:
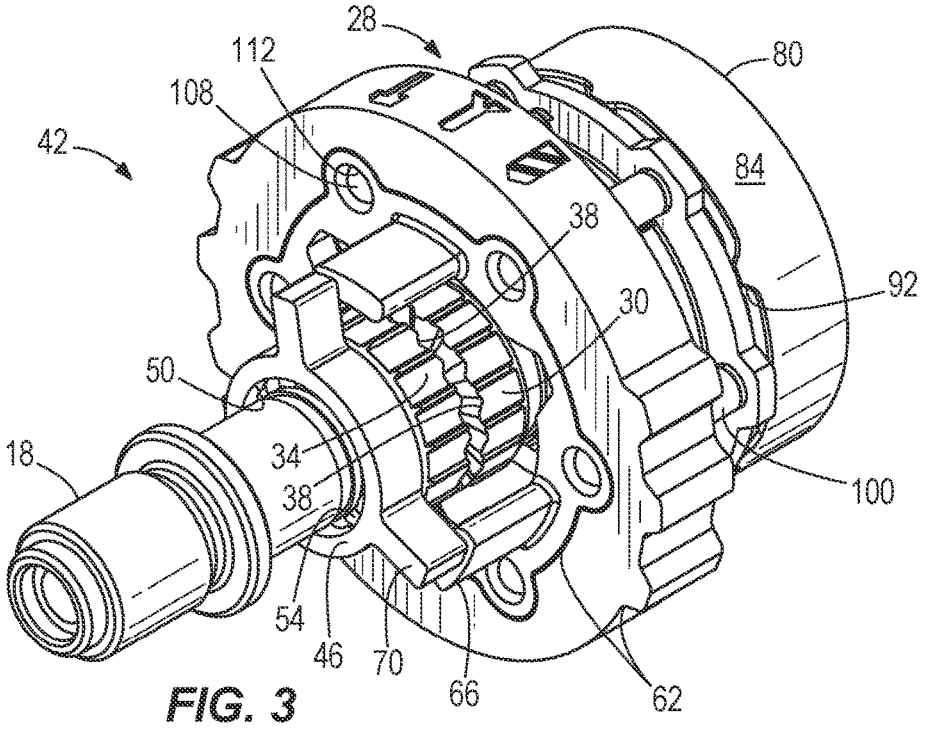
FIG. 3 is a perspective view of a hammer lockout mechanism of the power tool of FIG. 1 configured for operation in a driver mode.
Figure 4:
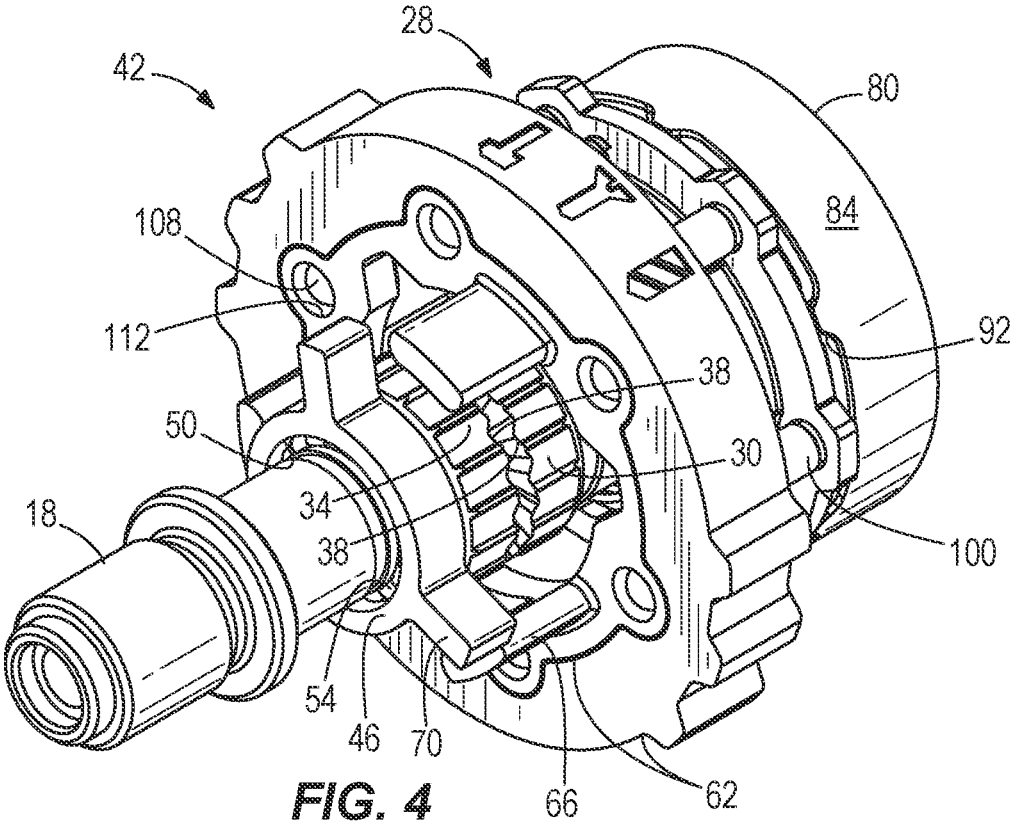
FIG. 4 is a perspective view of the hammer lockout mechanism of FIG. 3 configured for operation in a hammer-drilling mode.
Figure 5:
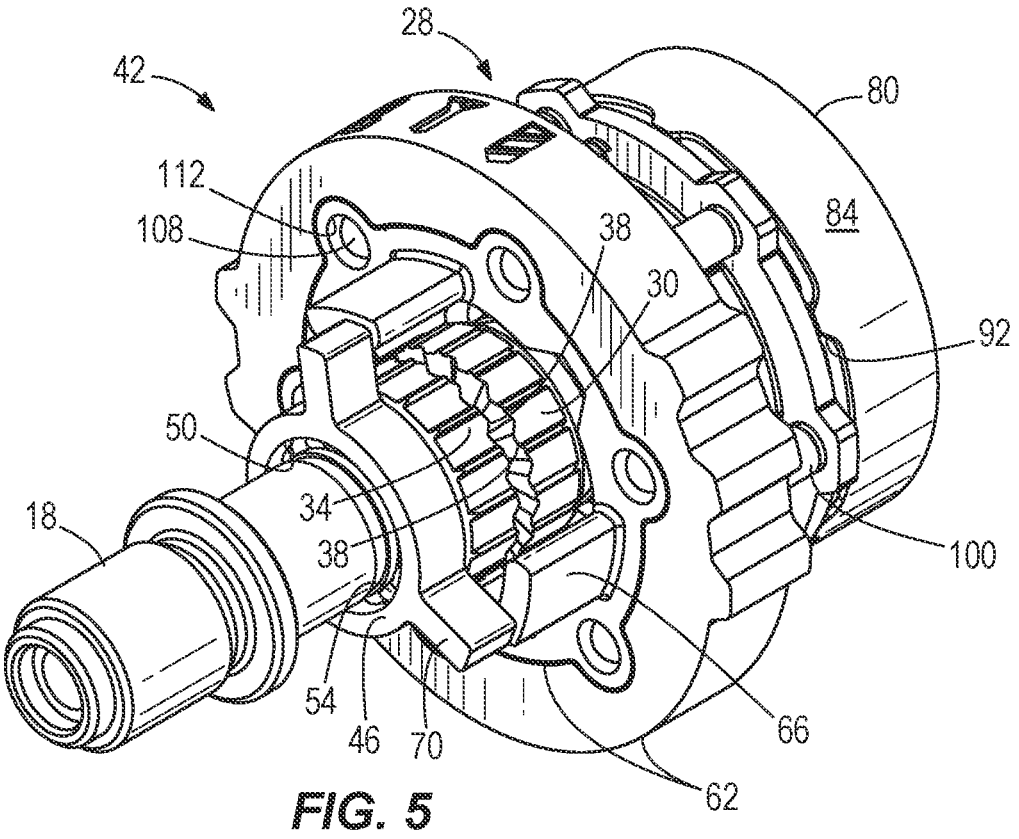
FIG. 5 is a perspective view of the hammer lockout mechanism of FIG. 3 configured for operation in a drilling mode.
Figure 6:
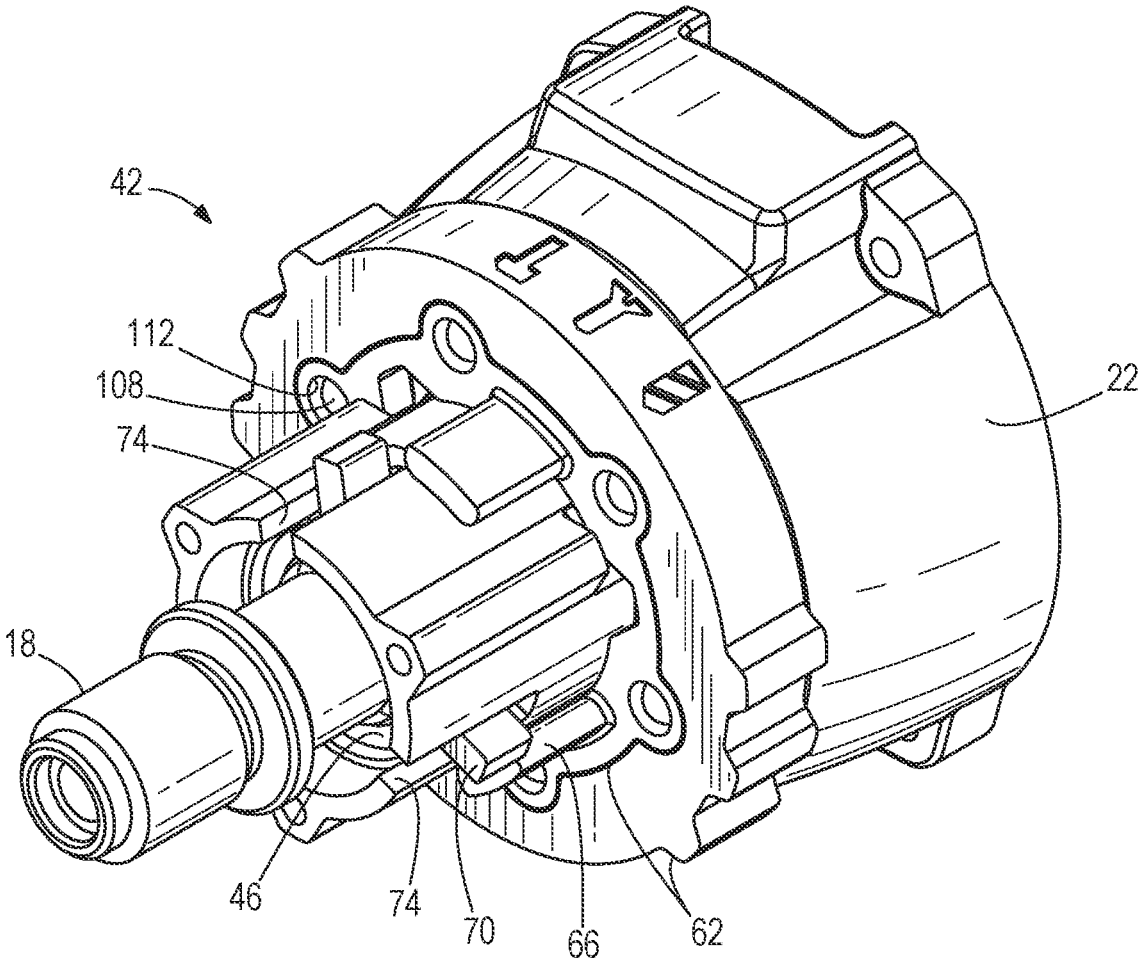
FIG. 6 is a partially-assembled view of the front end assembly of FIG. 2 configured for operation in a hammering mode.

With reference to FIGS. 3-5, the hammer lockout mechanism 42 also includes a mode selector ring 62 having axially extending posts 66 that are selectively engageable with corresponding radially extending arms 70 on the thrust bearing 46 (FIGS. 3 and 5). As such, interference between the arms 70 and the posts 66 prevents the spindle 18 from being displaced rearward, and therefore prevents the ratchets 30, 34 from engaging and imparting hammering action to the spindle 18 as it rotates. When the mode selector ring 62 is rotated to a position in which the posts 66 are misaligned with the arms 70 (FIG. 4), the spindle 18 is permitted to displace rearward to engage the ratchets 30, 34, therefore imparting hammering action to the spindle 18 as it rotates. As shown in FIG. 6, the front housing portion 22 includes longitudinal slots 74 in which the arms 70 slide, respectively, such that the thrust bearing 46 is prevented from rotating with respect to the front housing portion 22.

With reference to FIG. 2, the clutch mechanism 28 will now be described in detail. The planetary transmission 14 includes an outer ring gear 80 forming part of a third planetary gear stage of the transmission 14. An outer circumferential surface 84 of the outer ring gear 80 is cylindrical to enable the outer ring gear 80 to selectively rotate within the front housing portion 22. The outer ring gear 80 also includes an axial-facing cam track 88 having clutch dogs or ramps 92. The clutch mechanism 28 includes first cam members 96 (e.g., ball bearings) that engage the clutch dogs 92 on the outer ring gear 80. The clutch mechanism 28 also includes cylindrical pins 100 that are axially aligned with the first cam members 96 and received within corresponding through bores 104 in the front housing portion 22. Second cam members 108 (e.g., ball bearings) are contained within corresponding through-bores 112 in the mode selector ring 62. The cam members 108 are selectively aligned with the cam members 96 and the cylindrical pins 100, depending on a rotational position of the mode selector ring 62.

With continued reference to FIG. 2, the power tool also includes a torque adjustment mechanism 116 operable to allow a user of the power tool to adjust the torque limit of the clutch mechanism 28. In the illustrated embodiment, the torque adjustment mechanism 116 includes a sleeve 120 that is rotatable with respect to the front housing portion 22 to adjust the amount of torque that the spindle 18 is capable of applying to a workpiece. The torque adjustment mechanism 116 also includes an adjusting ring 124 having a threaded outer periphery 128 that is engageable with a threaded inner periphery 129 of the sleeve 120, such that relative rotation between the sleeve 120 and the ring 124 imparts axial movement to the ring 124. A compression spring 130 is axially contained between the adjusting ring 124 and a washer 132 abutting the mode selector ring 62 and the cam members 108. Axial movement of the ring 124 adjusts the preload on the spring 130 and thereby increases or decreases the axial force exerted on the washer 132 by the spring 130.

When the outer ring gear 80 is fixed with respect to the front housing portion 22, torque is transferred to the spindle 18. However, when a fastener exerts a reaction torque on the spindle 18 above a predetermined threshold (depending upon the rotational position of the sleeve 120), the spindle 18 seizes, thereby diverting torque from a motor 134 (FIG. 1) of the power tool 12 to the outer ring gear 80 (FIG. 2) to rotate the outer ring gear 80. As the ring gear 80 rotates, the cam members 96 ride up and over the clutch dogs 92 on the outer ring gear 80, thereby compressing the spring 130. The spring 130 then rebounds in response to the cam members 96 descending on the clutch dogs 92. The preload on the spring 130 may be adjusted by rotating the sleeve 120 which, in turn, incrementally moves the adjusting ring 124 in accordance with numbers or values imprinted on the sleeve 120. The greater the preload on the spring 130, the more torque can be transferred to the spindle 18 before any slippage occurs between the outer ring gear 80 and the front housing portion 22.

When the cam members 96 ride over the clutch dogs 92 on the outer ring gear 80, the cylindrical pins 100, the cam members 108, and the washer 132 are also displaced away from the cam track 88 of the ring gear 80 by the same amount. Therefore, if any of these components are prevented from moving away from the cam track 88, the cam members 96 jam against the clutch dogs 92 rather than being allowed to ride over the clutch dogs 92, thereby preventing the outer ring gear 80 from rotating relative to the front housing portion 22. Consequently, torque from the motor cannot be diverted from the spindle 18.

With reference to FIGS. 3 and 4, the mode selector ring 62 is also employed to selectively disable or enable the clutch mechanism 28 of the power tool (i.e., including the outer ring gear 80, the cam members 96, 108, the cylindrical pins 100, and the spring 130 discussed above). The mode selector ring 62 may be rotated such that the cam members 108 are aligned with the cam members 96 and the cylindrical pins 100 (FIGS. 2 and 3). As such, the clutch mechanism 28 is enabled and is not prevented from slipping, thereby allowing torque to be selectively diverted from the spindle 18 to the outer ring gear 80. The mode selector ring 62 may also be rotated such that the cam members 108 are misaligned with the cam members 96 and the cylindrical pins 100 to disable the clutch mechanism 28 (FIGS. 4 and 5). As such, the cam members 96 jam against the clutch dogs 92 and disable or prevent slippage of the clutch mechanism 28 (i.e., the outer ring gear 80 is prevented from rotating with respect to the front housing portion 22).

Operation of the hammer lockout mechanism 42 will now be discussed with respect to FIGS. 3-5.

FIG. 3 illustrates the hammer lockout mechanism 42 configured in a fastener-driving or driver mode. In this mode, interference between the arms 70 and the posts 66 prevents the spindle 18 from being displaced rearward to an extent where the rotating ratchet 34 engages the fixed ratchet 34, and therefore prevents the ratchets 30, 34 from imparting hammering action to the spindle 18 as it rotates. In addition, the clutch mechanism 28 is enabled, and the user may adjust the torque limit of the clutch mechanism 28 by rotating the sleeve 120 of the torque adjustment mechanism 116 (FIG.

2). To activate the hammering action on the spindle 18, a user incrementally rotates the mode selector ring 62 to the position shown in FIG. 4.

FIG. 4 illustrates the hammer lockout mechanism 42 configured in a hammer-drill mode. In the hammer-drill mode, the posts 66 are misaligned with the arms 70. The spindle 18 is therefore permitted to displace rearward in response to the tool bit being pressed against a workpiece. The rearward displacement of the spindle 18 causes the ratchets 30, 34 to engage, therefore imparting hammering action to the spindle 18 as it rotates. In addition, the clutch mechanism 28 is disabled, and the cam members 96 jam against the clutch dogs 92 on the outer ring gear 80 to prevent rotation or slippage of the outer ring gear 80 relative to the front housing portion 22.

FIG. 5 illustrates the hammer lockout mechanism 42 configured in a drill-only mode. As in the driver mode discussed above, interference between the arms 70 and the posts 66 prevents the spindle 18 from being displaced rearward to an extent where the rotating ratchet 34 engages the fixed ratchet 34, and therefore prevents the ratchets 30, 34 from imparting hammering action to the spindle 18 as it rotates. In addition, the clutch mechanism 28 is disabled, and the first cam members 96 jam against the clutch dogs 92 on the outer ring gear 80 to prevent rotation or slippage of the outer ring gear 80 relative to the front housing portion 22.

Various features of the invention are set forth in the following claims.

What is claimed is:

1. A hammer drill comprising:

a housing;

a first ratchet fixed to the housing;

a spindle rotatably supported by the housing about an axis;

a second ratchet coupled for co-rotation with the spindle, the second ratchet being engageable with the first ratchet in response to rearward displacement of the spindle to impart a hammering action on the spindle while the spindle rotates;

a thrust bearing for absorbing an axial load on the spindle in response to the rearward displacement of the spindle, the thrust bearing including an arm extending away from the axis;

a selector ring including a post extending toward the arm, the selector ring being rotatable between a first position in which the post is engageable with the arm of the thrust bearing to thereby limit the rearward displacement of the spindle and prevent engagement of the first and second ratchets, and a second position in which the post is misaligned with the arm of the thrust bearing to permit the rearward displacement of the spindle and engagement of the first and second ratchets; and a clutch mechanism operable to limit torque output to the spindle.

2. The hammer drill of claim 1, wherein the arm on the thrust bearing is one of a plurality of arms extending away from the axis, and wherein the post on the selector ring is one of a plurality of posts extending toward the arms.

3. The hammer drill of claim 2, wherein each of the posts is engageable with one of the arms of the thrust bearing to thereby limit the rearward displacement of the spindle when the selector ring is in the first position.

4. The hammer drill of claim 2, wherein the posts are misaligned with the arms of the thrust bearing to permit the rearward displacement of the spindle and engagement of the first and second ratchets when the selector ring is in the second position.

5. The hammer drill of claim 1, wherein the housing includes a longitudinal slot, and wherein the arm of the thrust bearing is slidably received in the slot to substantially inhibit rotation of the thrust bearing relative to the housing.

6. The hammer drill of claim 1, wherein the selector ring is rotatable to a third position, wherein the first position corresponds to a first operational mode of the hammer drill, the second position corresponds to a second operational mode of the hammer drill, and the third position corresponds to a third operational mode of the hammer drill.

7. The hammer drill of claim 1, further comprising a resilient member configured to bias the spindle in a forward direction in the housing.

8. The hammer drill of claim 1, wherein the spindle includes a shoulder, and wherein the thrust bearing includes an interior raceway and a plurality of ball bearings positioned between the raceway and the shoulder.

9. The hammer drill of claim 8, wherein the thrust bearing is generally axially constrained on the spindle in a forward direction by the ball bearings and the shoulder.

10. The hammer drill of claim 1, wherein the thrust bearing is generally axially constrained on the spindle in a rearward direction by the second ratchet.

11. The hammer drill of claim 1, wherein the second ratchet is fixed relative to the spindle using an interference fit with the spindle.

12. The hammer drill of claim 1, wherein the first ratchet is fixed relative to the housing using an interference fit with the housing.

13. The hammer drill of claim 1, wherein the clutch mechanism includes a first clutch member and a second clutch member, wherein the first and second clutch members are axially aligned to enable the clutch mechanism to limit torque output to the spindle, and wherein the first and second clutch members are axially misaligned to disable the clutch mechanism.

14. The hammer drill of claim 13, wherein the first and second clutch members are ball bearings.

15. The hammer drill of claim 13, wherein the clutch mechanism further includes a pin disposed between the first and second clutch members, the pin configured to selectively transmit axial movement of the first clutch member to the second clutch member when the clutch mechanism is enabled.

16. The hammer drill of claim 13, wherein the second clutch member is supported by the selector ring for rotation with the selector ring.

17. The hammer drill of claim 1, wherein the clutch mechanism is disabled in the second position of the selector ring for operation in a hammer-drill mode.

18. The hammer drill of claim 1, wherein the clutch mechanism is enabled in the first position of the selector ring for operation in a driver or fastening mode.

19. The hammer drill of claim 1, wherein the selector ring is rotatable to a third position in which the post is engageable with the arm of the thrust bearing to thereby limit the rearward displacement of the spindle and prevent engagement of the first and second ratchets, and wherein the clutch mechanism is disabled in the third position of the selector ring for operation in a drill-only mode.

* * * * *